United States Patent [19]

Russell et al.

[11] Patent Number: 4,636,995

[45] Date of Patent: Jan. 13, 1987

[54] MUD PRESSURE CONTROL SYSTEM

[75] Inventors: Michael K. Russell; Anthony W. Russell, both of Cheltenham, England

[73] Assignee: NL Sperry-Sun, Inc., Stafford, Tex.

[21] Appl. No.: 764,167

[22] Filed: Aug. 9, 1985

Related U.S. Application Data

[63] Continuation of Ser. No. 295,431, Aug. 24, 1981, abandoned.

[30] Foreign Application Priority Data

Aug. 27, 1980 [GB] United Kingdom ..... 8027727
Nov. 20, 1980 [GB] United Kingdom ..... 8037213

[51] Int. Cl.[4] ..... G01V 1/40; E21C 7/08

[52] U.S. Cl. ..... 367/85; 367/83; 175/48; 33/306

[58] Field of Search ..... 367/83, 85; 166/66; 175/40, 45, 48, 50; 33/304, 306, 307

[56] References Cited

U.S. PATENT DOCUMENTS 3,867,714 2/1975 Patton ..... 367/85
3,983,948 10/1976 Jeter ..... 367/83

*Primary Examiner*—Nelson Moskowitz
*Attorney, Agent, or Firm*—Carl O. McClenny; William E. Johnson, Jr.

[57] ABSTRACT

A down-hole signal generator for a mud-pulse telemetry system comprises a flow constrictor defining a throttle orifice for the mud passing along a drill string, a throttling member displaceable with respect to a casing to modulate the mud pressure for the purpose of transmitting measurement data up the drill string, and a turbogenerator incorporating an electrical generator within the casing. The flow constrictor and casing form an integrated unit which is installed within a drill collar and is retrievable by drawing it up the inside of the drill string. The throttling member is displaced by a pump according to the torque required to drive the rotor of the generator which is dependent on the electrical load of the generator. The pump incorporates a rotary valve member which supplies the output of the pump to one or other side of a double-acting ram according as to whether the valve member is rotating with a first phase of rotation or a second phase of rotation. The phase of rotation is determined by a torque-sensitive actuator coupled to the valve member by a shaft and incorporating an escapement plate tiltable about an axis transverse to the shaft by a torque drive arm for driving the rotor.

10 Claims, 4 Drawing Figures

MUD PRESSURE CONTROL SYSTEM

This is a continuation of application Ser. No. 295,431, filed Aug. 24, 1981, now abandoned.

CROSS-REFERENCE TO RELATED APPLICATIONS

Applicant claims priority for this application from British Patent ApplicationNos. 8027727 filed on Aug. 27, 1980 and 8037213 filed on Nov. 20, 1980.

BACKGROUND OF THE INVENTION

This invention relates to apparatus for signalling within a borehole while drilling, and is more particularly concerned with a down-hole signal transmitter for a mud-pulse telemetry system.

Various types of measurements-while-drilling (MWD) systems have been proposed for taking measurements within a borehole while drilling is in progress and for transmitting the measurement data to the surface. However to date only one type of system has enjoyed commercial success, that is the so-called mud-pulse telemetry system. In that system the mud stream, which passes down the drill string to the drill bit and then back up the annular space between the drill string and the bore wall with the object of lubricating the drill string and carrying away the drilling products, is used to transmit the measurement data from a down-hole measuring instrument to a receiver and data processor at the surface. This is achieved by modulating the mud pressure in the vicinity of the measuring instrument under control of the electrical output signal from the measuring instrument, and sensing the resultant mud-pulses at the surface by means of a pressure transducer.

Current mud-pulse telemetry systems utilize a down-hole signal transmitter which is built into the drill collar. These systems therefore suffer from the disadvantage that, in the event of instrumentation failure in the transmitter, the complete drill string must be withdrawn to enable the faulty part to be replaced. Moreover the combined transmitter/drill collar is very costly to produce. It is an object of the invention to provide a generally improved down-hole signal transmitter for a mud-pulse telemetry system.

SUMMARY OF THE INVENTION

According to the invention there is provided a down-hole signal transmitter for a mud-pulse telemetry system, comprising a flow constrictor defining a throttle orifice for the mud passing along a drill string, a throttling member displaceble with respect to the throttle orifice to vary the throughflow cross-section of the throttle orifice, and control means for displacing the throttling member to modulate the mud pressure, wherein the flow constrictor, throttling member and control means are formed as an integrated unit which is adapted to be installed within a drill collar disposed at the end of the drill string and which is capable of being retrieved by drawing it up the inside of the drill string.

A fishing neck may be attached to the unit to enable the unit to be retrieved by engaging the fishing neck with a gripping device at the end of a line.

Accordingly, in the event of instrumentation failure, it is a simple matter to retrieve the transmitter by inserting a wireline down the drill string, engaging the wireline with the fishing neck, for example by means of a per se known gripping device on the end of the wireline, and drawing the transmitter up the drill string on the end of the wireline. Furthermore the transmitter is a self-contained unit which is relatively inexpensive to produce and may therefore be replaced at low cost.

The invention also provides a down-hole signal transmitter for a mud-pulse telemetry system, comprising a flow constrictor defining a throttle orifice for the mud passing along the drill string, a throttling member displaceable with respect to the throttle orifice to vary the throughflow cross-section of the throttle orifice, a turbogenerator for supplying a measuring instrument and arranged to be driven by the mud flow passing along the drill string, and control means for displacing the throttling member to modulate the mud pressure, wherein the control means is coupled to the rotor of the turbogenerator and is adapted to modulate the mud pressure according to the torque required to drive the rotor which is dependent on the electrical load of the turbogenerator.

Such an arrangement is particularly convenient as it not only produces the required mud pulses for transmitting the measurement data to the surface, but also generates the electrical power required for operating the measuring instrument and/or other devices.

Preferably the control means is adapted to displace the throttling member in one direction when the electrical load of the turbogenerator is such that the torque required to drive the rotor exceeds the maximum torque available for driving the rotor, and to displace the throttling member in the opposite direction when the electrical load is such that the torque required to drive the rotor does not exceed the maximum available driving torque.

In a preferred form of the invention the control means incorporates a ram coupled to the throttling member, a pump for supplying hydraulic fluid to the ram, and a torque-sensitive actuator for controlling supply of hydraulic fluid from the pump to the ram. Conveniently the ram is double-acting, and the torque-sensitive actuator is adapted to supply hydraulic fluid to one side of the ram to displace the throttling member in said one direction or to the opposite side of the ram to displace the throttling member in said opposite direction, according to the torque required to drive the rotor.

The pump may incorporate a rotary valve member for supplying hydraulic fluid from the pump to said one side of the ram when rotating with a first phase and to said opposite side of the ram when rotating with a second phase, the torque-sensitive actuator being adapted to control the phase of rotation of the rotary valve member. The pump may also incorporate a plurality of cylinders having pistons arranged to be driven cyclically, the rotary valve member being adapted to connect each cylinder in turn to one side of the ram during rotation.

The torque-sensitive actuator may comprise a drive plate coupled to the rotary valve member and an escapement plate for driving both the drive plate and the rotor, the escapement plate being adaped to engage the drive plate in a first relative rotational position or in a second relative rotational position during rotation of the plates, according to the torque required to drive the rotor. Preferably the escapement plate is tiltable about a tilt axis transverse to its axis of rotation to change the relative rotational position of the drive plate and escapement plate, and is coupled to the rotor by a torque drive arm which is adapted to tilt the escapement plate when the torque required to drive the rotor exceeds the maximum driving torque available at the escapement plate.

BRIEF DESCRIPTION OF THE DRAWINGS

In order that the invention may be more fully understood, a preferred form of down-hole signal transmitter in accordance with the invention will now be described, by way of example, with reference to the accompanying drawings, in which.

DETAILED DESCRIPTION OF THE INVENTION

Figure 1:
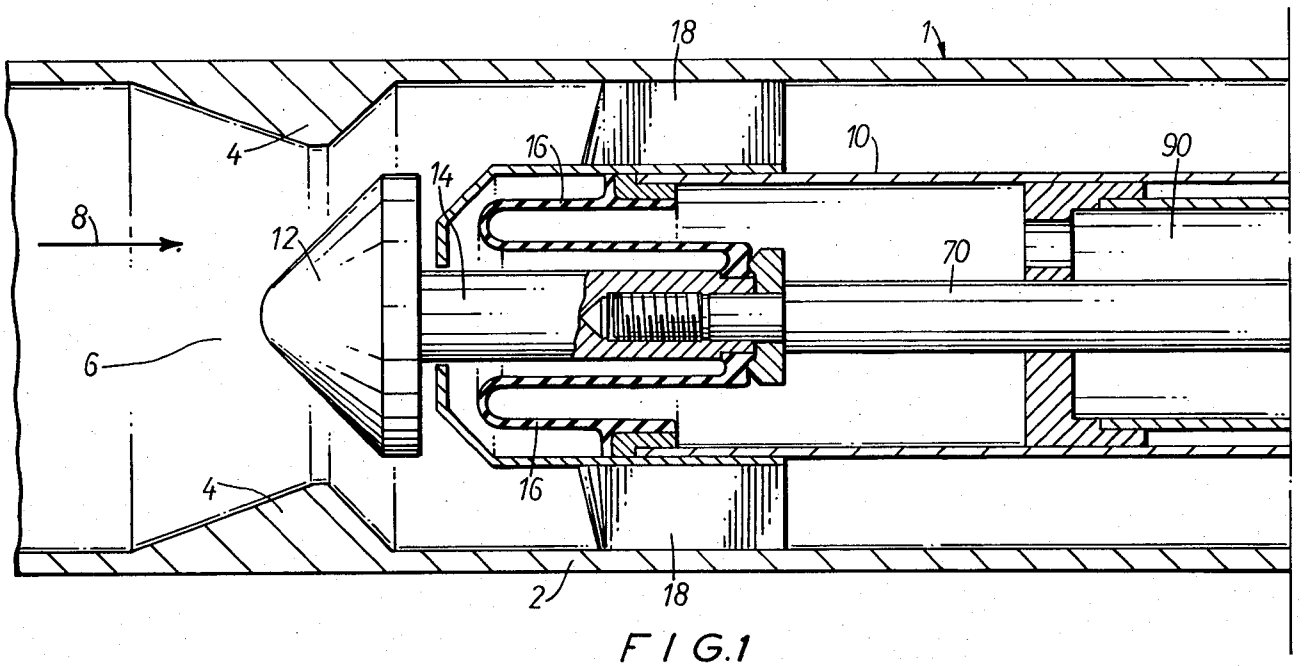
FIG. 1 is a longitudinal section through an upper part of the transmitter.

The signal transmitter 1 illustrated in the drawings is installed in use within a non-magnetic drill collar and coupled to a measuring instrument disposed in an instrument pressure casing installed within the drill collar immediately below the transmitter 1. The drill collar is disposed at the end of a drill string within a borehole during drilling, and the measuring instrument may serve to monitor the inclination of the borehole in the vicinity of the drill bit during drilling, for example. The signal transmitter 1 serves to transmit the measurement data to the surface in the form of pressure pulses by modulating the pressure of the mud which passes down the drill string. The transmitter 1 is formed as a self-contained unit and is installed within the drill collar in such a manner that it may be retrieved, in the event of instrumentation failure for example, by inserting a wireline down the drill string and engaging the wireline with a fishing neck on the transmitter, for example by means of a per se known gripping device on the end of the wireline, and drawing the transmitter up the drill string on the end of the wireline.

Figure 2:
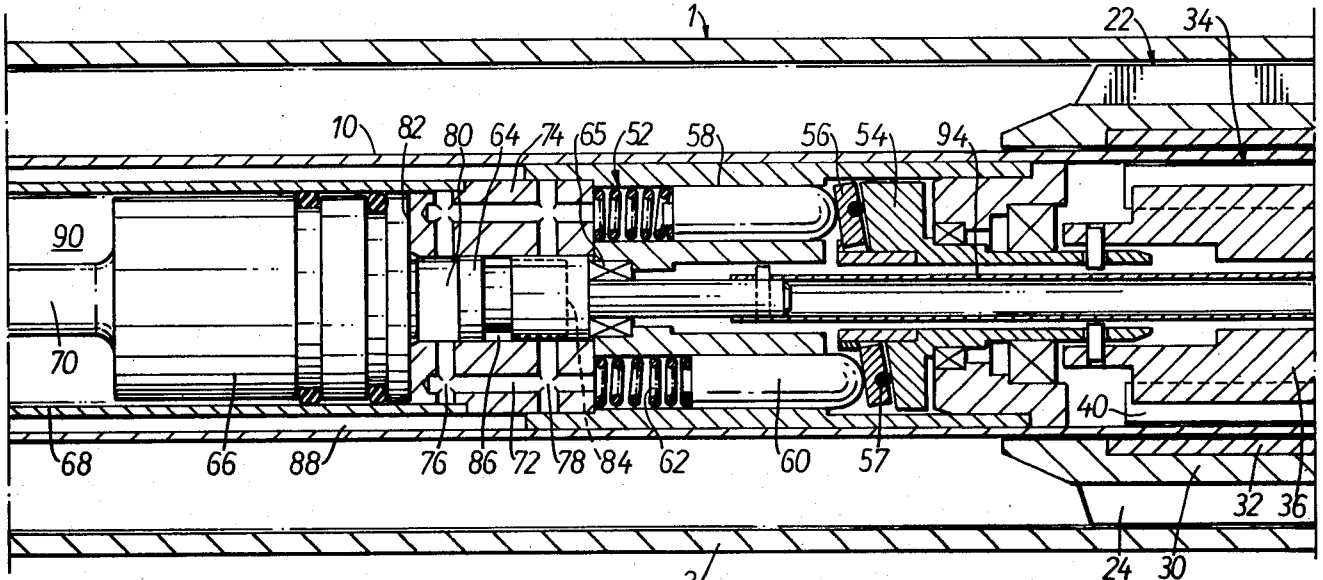
FIG. 2 is a longitudinal section through a central part of the transmitter.
Figure 3:
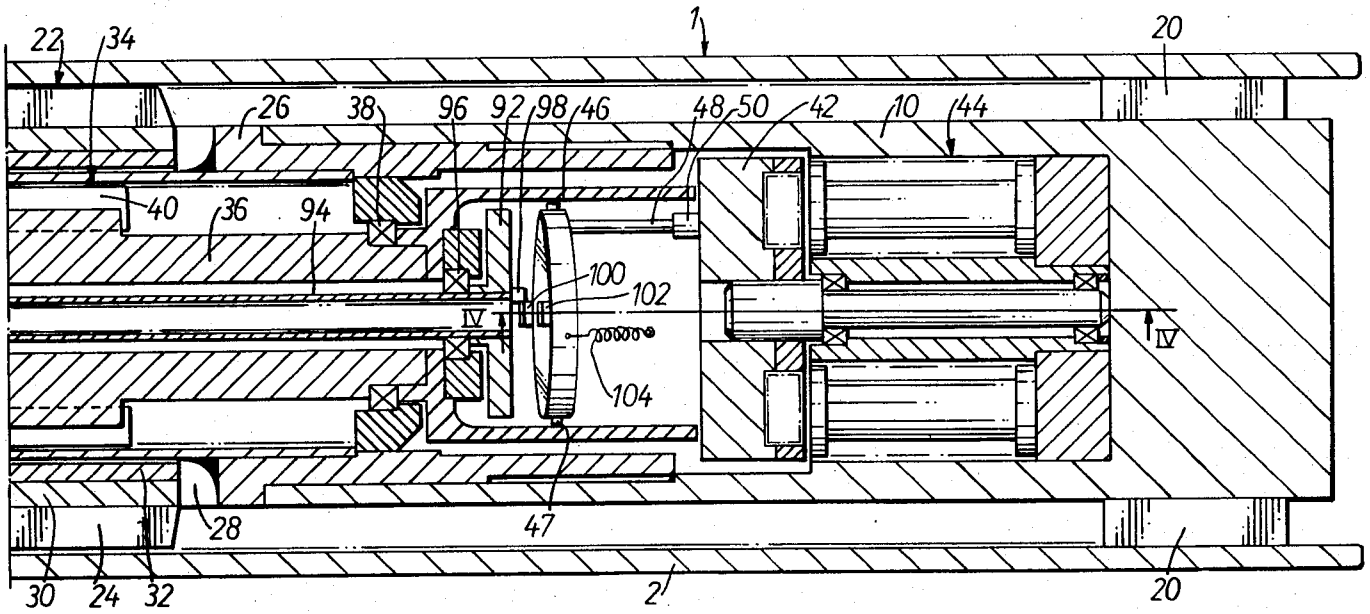
FIG. 3 is a longitudinal section through a lower part of the transmitter.

Referring to FIGS. 1 to 3, the transmitter 1 includes a duct 2 provided, at its upper end, with an annular flow constrictor 4 defining a throttle orifice 6 for the mud passing down the drill string in the direction of the arrow 8. Within the duct 2 is an elongate casing 10 bearing at its upper end, in the vicinity of the throttle orifice 6, a throttling member 12 which is displaceable with respect to the casing 10 in the direction of the axis of the duct 2 to vary the throughflow cross-section of the throttle orifice 6. The throttling member 12 is provided with a shaft 14 which extends into the casing 10, the space within the casing 10 being filled with hydraulic oil in order to ensure hydrostatic pressure balance and being sealed at its upper end by a Viton diaphragm 16 extending between the inside wall of the casing 10 and the shaft 14. The casing 10 is rigidly mounted within the duct 2 by three upper support webs 18 and three lower support webs 20 extending radially between the casing 10 and the duct 2, so as to provide an annular gap between the casing 10 and the duct 2 for mud flow.

An annular impeller 22 having a series of blades 24 distributed around its periphery and angled to the mud flow surrounds the casing 10, and is carried on a shoulder 26 of the casing 10 by means of a filled PTFE (polytetrafluoroethylene) thrust bearing 28. The blades 24 are mounted on a magnetisable steel boss 30 which surrounds a copper drive ring 32. A rare earth magnet assembly 34 is carried by an annular shaft 36 rotatably mounted within the casing 10 by means of bearings such as 38, and incorporates six Sm Co (samarium-cobalt), magnets 40 distributed about the periphery of the shaft 36. Three of the magnets 40 have their North poles facing radially outwardly and a further three of the magnets 40, alternating with the previous three magnets 40, have their South poles facing radially outwardly. As the impeller 22 rotates in the mud flow, eddy currents will be induced in the copper drive ring 32 by the intense magnetic field associated with the six Sm Co magnets 40, the magnetisable steel boss 30 providing return paths for the magnetic flux, and the magnet assembly 34 and hence the shaft 36 will be caused to rotate with the impeller 32 by virtue of the interaction between the magnetic field associated with the magnets 40 and the magnetic field associated with the eddy currents induced in the drive ring 32.

The annular shaft 36 drives a rotor 42 of an electrical generator 44 for supplying power to the measuring instrument by way of a circular escapement plate 46, pivotally mounted within the shaft 36 by pivot pins 47, and a torque drive arm 48 (see FIG. 4) attached to the periphery of the plate 46 and arranged to engage a drive pin 50 attached to the periphery of the rotor 42. In addition the annular shaft 36 drives a hydraulic pump 52 by way of an angled swashplate 54 and an associated piston thrust plate 56 provided with a bearing race 57.

The hydraulic pump 52 comprises eight cylinders 58 extending parallel to the axis of the casing 10 and arranged in an annular configuration, and a respective piston 60 associated with each cylinder 58. The lower end of each piston 60 is permanently biased into engagement with the thrust plate 56 by a respective piston return spring 62, so that rotation of the swashplate 54 with the shaft 36 will cause the pistons 60 to axially reciprocate within their cylinders 58, the eight pistons 60 being reciprocated cyclically so that when one of the pistons is at the top of its stroke the diametrically opposing pistons will be at the bottom of its stroke and vice versa. In addition the pump 52 comprises a rotary valve member 64 mounted on bearings 65 and intended to rotate in synchronism with the swashplate 54 so as to supply the output from each cylinder 58 in turn to one side of a double-acting ram 66 disposed within a cylinder 68. The double-acting ram 66 is coupled to the shaft 14 of the throttling member 12 by an output shaft 70, so that the throttling member 12 may be displaced by the pump 52 to vary the throughflow cross-section of the throttle orifice 6.

More particularly the hydraulic oil which fills the casing 10 and which is supplied to each of the cylinders 58 from one side of the double-acting ram 66 is forced by the associated piston 60 into a respective axial bore 72 in a valve housing 74 which surrounds the rotary valve member 64 on the upstroke of the piston 60. Each of the axial bores 72 is crossed by a respective upper radial bore 76 and a respective lower radial bore 78. The rotary valve member 64 is provided with an upper peripheral recess 80 which opens out at the periphery of the valve member 64 over approximately 180° of arc and which also opens at the top of the valve member 64 into the lower part 82 of the cylinder 68 below the ram 66, and a lower peripheral recess 84 (shown in FIG. 2 in broken lines) which opens out at the periphery of the valve member 64 over approximately 180° of arc on the opposite side of the valve member 64 to the upper peripheral recess 80 and which also opens at its upper region into a central annular recess 86 formed in the valve member 64. The central annular recess 86 is permanently maintained in fluid communication with an annular passage 88 surrounding the cylinder 68 and valve housing 74 by radial passages (not shown) extending through the valve housing 74. The annular passage 88 is itself in fluid communication with the upper part 90 of the cylinder 68 above the ram 66.

There are two possible phases of rotation of the rotary member 64 with respect to the rotation of the swashplate 54, namely a first phase of rotation in which the upper peripheral recess 80 communicates with the upper radial bores 76 on the upstroke of the associated pistons 60 and the lower peripheral recess 84 communicates with the lower radial bores 78 on the downstroke of the associated pistons 60, and a second phase of rotation in which the upper peripheral recess 80 communicates with the upper radial bores 76 on the downstroke of the associated pistons 60 and the lower peripheral recess 84 communicates with the lower radial bores 78 on the upstroke of the associated pistons 60. Thus, during the first phase of rotation of the valve member 64, the input of the pump 52 will be connected to the upper part 90 of the cylinder 68 and the output of the pump 52 will be connected to the lower part 82 of the cylinder 68, so that the ram 66 and hence the throttling member 12 will be displaced upwardly. Conversely, during the second phase of rotation of the valve member 64, the input of the pump 52 will be connected to the lower part 82 of the cylinder 68 and the output of the pump 52 will be connected to the upper part 90 of the cylinder 68, so that the ram 66 and the throttling member 12 will be displaced downwardly.

The rotary valve member 64 is coupled to a torque-sensitive actuator, comprising a circular drive plate 92 disposed opposite the escapement plate 46, by a drive shaft 94 rotatably mounted within the annular shaft 36 by bearings 96. The drive plate 92 is provided with a driven pin 98 at its periphery which is engaged by a first escapement pin 100 at a first rotational position at the periphery of the escapement plate 46 in order to cause the valve member 64 to be driven by the shaft 36 with the first phase of rotation or alternatively by a second escapement pin 102 (see FIG. 4), which is disposed at a second rotational position offset by 180° with respect to the first rotational position at the periphery of the escapement plate 46, in order to cause the valve member 64 to be driven by the shaft 36 with the second phase of rotation.

Figure 4:
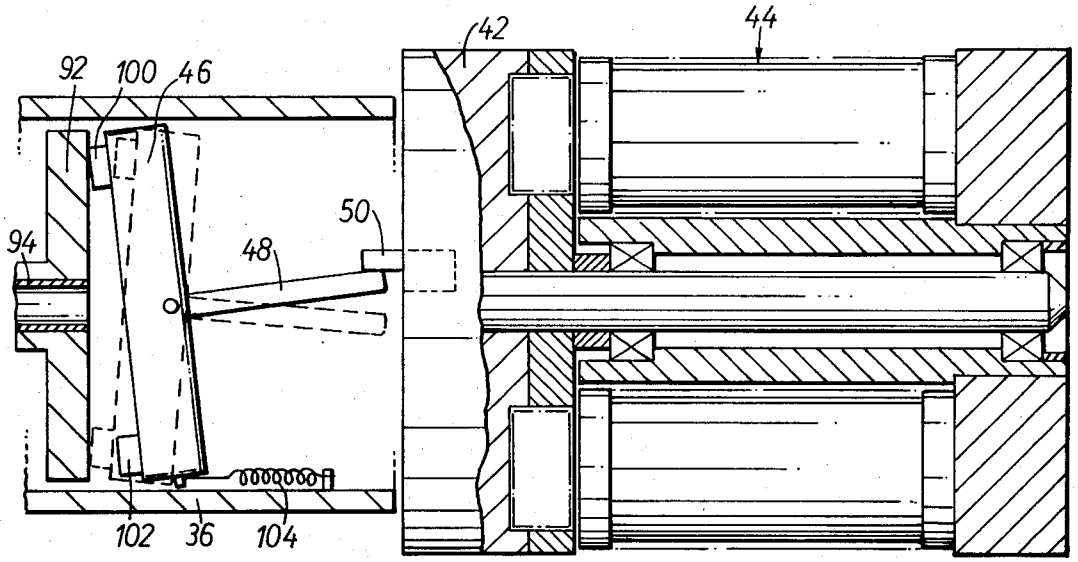
FIG. 4 is a longitudinal section through a portion of the lower part, taken along the line IV—IV in FIG. 3.

As shown clearly in FIG. 4, which shows a section taken along the line IV—IV in FIG. 3 but with the casing 10 and the duct 2 omitted, the escapement plate 46 is capable of being tilted about a tilt axis defined by the pivot pins 47 between a first angled position (shown in solid lines in FIG. 4) and a second angled position (shown in broken lines in FIG. 4). A tension spring 104 biases the escapement plate 46 into its first angled position. For relatively low electrical loads applied to the output of the generator 44, the escapement plate 46 will drive the drive plate 92 with the first phase of rotation by means of the first escapement pin 100 and will also drive the rotor 42 of the generator 44 by way of the torque drive arm 48. However, if the generator load increases to a point where the torque required to drive the rotor 42 is sufficient to overcome the bias of the spring 104, the torque drive arm 48 will be caused to tilt the escapement plate 46 into its second angled position against the action of the spring 104. This will cause the first escapement pin 100 to be brought out of engagement with the driven pin 98 of the drive plate 92, and the second escapement pin 102 to be engaged with the driven pin 98 after the escapement plate 46 has rotated through 180° with respect to the drive plate 92. This will cause the drive plate 92 to be driven with the second phase of rotation by means of the second escapement pin 102, and the supply by hydraulic fluid from the pump 52 to the double-acting ram 66 will be reversed. Of course, if the generator load subsequently decreases to a sufficient extent, the spring 104 will tilt the escapement plate 46 back into its first angled position, and the drive plate 92 will again be driven with the first phase of rotation.

It will therefore be appreciated that, if the measurement data from the measuring instrument is arranged to suitably vary the electrical load of the generator 44, the phase of rotation of the rotary valve member 64, and hence the direction of displacement of the double-acting arm 66, will vary with the output of the measuring instrument. This will in turn cause the throttling member 12 to be displaced with respect to the throttle orifice 6 to modulate the pressure of the mud flow upstream of the throttle orifice 6, and will produce a series of pressure pulses corresponding to the measurement data which will travel upstream in the mud flow and may be sensed at the surface by a pressure transducer in the vicinity of the output of the pump producing the mud flow. This arrangement therefore enables data in digital form to be transmitted to the surface.

The duct 2 has an outside diameter, of, for example, 2¾ inches, which is slightly less than the internal diameter of the drill collar which is typically 2 13/16 inches, and the casing 10 is screwed to the casing of the measuring instrument so as to enable the measuring instrument to be retrieved with with the signal transmitter. The signal transmitter/measuring assembly is installed with a predetermined orientation within the drill collar, which is in the form of a bent sub, by virtue of a per se known mule shoe coupling between the instrument casing and the drill collar. More particularly a projection on the inside wall of the drill collar in the vicinity of the bent portion of the collar engages within a slot in the cylindrical wall of the instrument casing, the slot being open at its lower end and tapering upwardly to a level at which the assembly is held at the desired orientation with respect to the collar with the projection engaged between the opposing walls of the slot.

What is claimed is:

1. A down-hole signal transmitter for a mud-pulse telemetry system, comprising a flow constrictor defining a throttle orifice for the mud passing along a drill string, a throttling member displaceable as a whole towards and away from the throttle orifice to vary the throughflow cross-section of the throttle orifice, a turbogenerator for supplying a measuring instrument and arranged to be driven by the mud flow passing along the drill string, and control means for controlling displacement of the throttling member towards and away from the throttle orifice to modulate the mud pressure, wherein the control means is coupled to the rotor of the turbogenerator and is adapted to displace the throttling member in one direction when the electrical load of the turbogenerator is such that the torque required to drive the rotor exceeds the maximum torque available for driving the rotor, and to displace the throttling member in the opposite direction when the electrical load of the generator is such that the torque required to drive the rotor does not exceed the maximum torque available for driving the rotor.

2. A transmitter according to claim 1, wherein the control means incorporates a ram coupled to the throttling member, a pump for supplying hydraulic fluid to the ram, and a torque-sensitive actuator for controlling the supply of hydraulic fluid from the pump to the ram.

3. A transmitter according to claim 2, wherein the ram is double-acting, and the torque-sensitive actuator is adapted to supply hydraulic fluid to one side of the ram to displace the throttling member in said one direction or to the opposite side of the ram to displace the throttling member in said opposite direction, according to the torque required to drive the rotor.

4. A transmitter according to claim 3, wherein the pump incorporates a rotary valve member for supplying hydraulic fluid from the pump to said one side of the ram when rotating with a first phase and to said opposite side of the ram when rotating with a second phase, the torque-sensitive actuator being adapted to control the phase of rotation of the rotary valve member.

5. A transmitter according to claim 4, wherein the pump also incorporates a plurality of cylinders having pistons arranged to be driven cyclically, the rotary valve member being adapted to connect each cylinder in turn to one side of the ram during rotation.

6. A transmitter according to claim 5, wherein the rotary valve member is provided with a first peripheral recess in fluid communication with said one side of the ram and arranged to intermittently communicate with each of the pump cylinders during rotation of the rotary valve member, and second peripheral recess, circumferentially offset with respect to the first peripheral recess, in fluid communication with said opposite side of the ram and also arranged to intermittently communicate with each of the pump cylinders during rotation of the rotary valve member.

7. A transmitter according to claim 4, wherein the torque-sensitive actuator comprises a drive plate coupled to the rotary valve member and an escapement plate for driving both the drive plate and the rotor, the escapement plate being adapted to engage the drive plate in a first relative rotational position or in a second relative rotational position during rotation of the plates, according to the torque required to drive the rotor.

8. A transmitter according to claim 7, wherein the escapement plate is tiltable about a tilt axis transverse to its axis of rotation to change the relative rotational position of the drive plate and escapement plate, and is coupled to the rotor by a torque drive arm which is adapted to tilt the escapement plate when the torque required to drive the rotor exceeds the maximum driving torque available at the escapement plate.

9. A transmitter according to claim 8, wherein one of the plates incorporates first and second pins at first and second rotational positions respectively, and the other plate incorporates a third pin for engagement with either the first pin or the second pin during rotation of the plates according to whether the escapement plate is in a first angled position or a second angled position with respect to said tilt axis.

10. A transmitter according to claim 8, wherein the escapement plate is biased into a first angled position with respect to said tilt axis by a spring.

* * * * *